United States Patent [19]

Smith

[11] Patent Number: 4,828,169

[45] Date of Patent: May 9, 1989

[54] ADJUSTABLE AIR VALVE

[76] Inventor: Daniel J. Smith, R.D. 1, Box 673 C, Gardiner, N.Y. 12525

[21] Appl. No.: 242,704

[22] Filed: Sep. 9, 1988

[51] Int. Cl.[4] ..... F16K 74/02

[52] U.S. Cl. ..... 236/66; 138/46; 236/93 R; 236/101 E

[58] Field of Search ..... 138/45, 46; 236/66, 236/93 R, 101 E

[56] References Cited

U.S. PATENT DOCUMENTS

| | | | |
|---|---|---|---|
| 2,509,482 | 5/1950 | Crise | 236/93 R X |
| 2,576,954 | 12/1951 | Lucks | 236/66 |
| 2,589,888 | 3/1952 | Stampfl | 138/45 |
| 2,685,891 | 8/1954 | Segelhorst et al. | 138/45 X |
| 2,715,420 | 8/1955 | Stearns | 138/45 |
| 3,148,829 | 9/1964 | Leopardo | 236/66 |
| 3,260,458 | 7/1966 | Klinefelter | 236/66 |
| 3,342,411 | 9/1967 | Quist | 236/66 |
| 4,506,991 | 3/1985 | Hudson | 138/45 X |

*Primary Examiner*—William E. Tapolcai
*Attorney, Agent, or Firm*—Schweitzer & Cornman

[57] ABSTRACT

An adjustable air valve for steam radiators, comprising a cylindrical valve body of seamless brass having a predetermined outer diameter; an upper circular disc cap closing off the top end of said valve body; a lower circular disc cap closing off the lower end of said valve body; a frusto-conical vent wall portion defining a vent orifice of fixed diameter formed integrally within said valve body proximate to said upper cap; said orifice lying in a vertical plane disposed radially inwardly of the outer cylindrical envelope of said valve body; a U-shaped bi-metallic spring cantilevered from inner portions of said valve body opposite said vent orifice; an elastomeric sealing member having a flat circular sealing surface of diameter in excess of the diameter of said vent orifice; said spring being adapted to expand and to contract in response to temperature variations to move said sealing surface selectively into and out of seal contact with said orifice; a cylindrical band having a series of apertures of graduated size; said band mounted externally of said valve housing for circular movement thereabout and in juxtaposition with the outer portion of said frusto-conical vent, whereby the effective diameter of the vent may be varied by selective juxtaposition of different sized apertures with said outer portion; and a threaded fitting disposed at the bottom of said valve body adapted to provide communication with an attachment to a steam radiator.

3 Claims, 2 Drawing Sheets

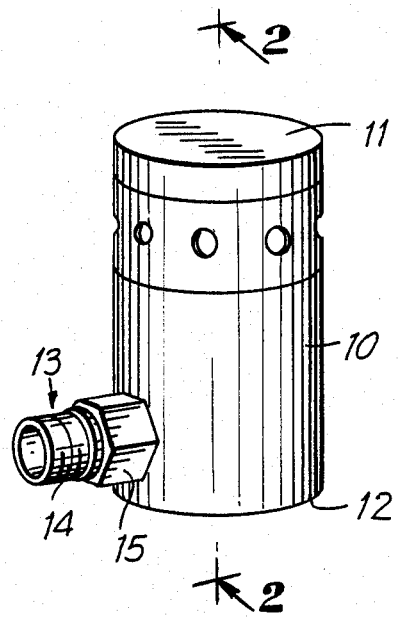
FIG. 1
FIG. 2
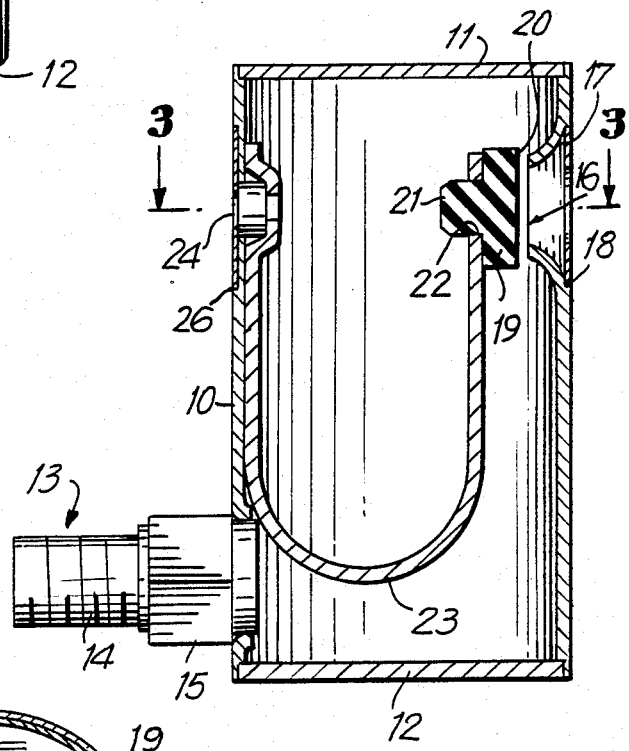
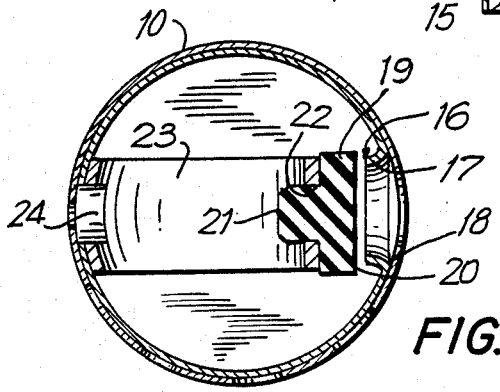
FIG. 3

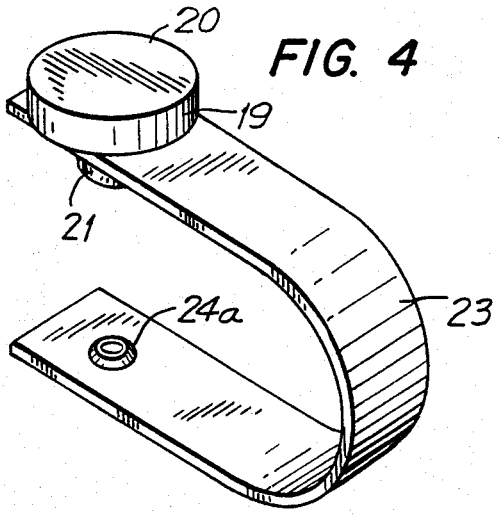
FIG. 4
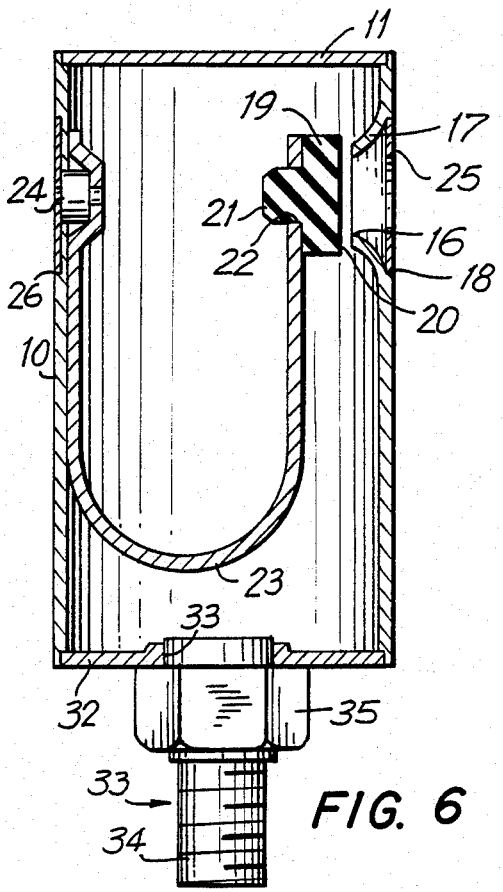
FIG. 6
FIG. 5
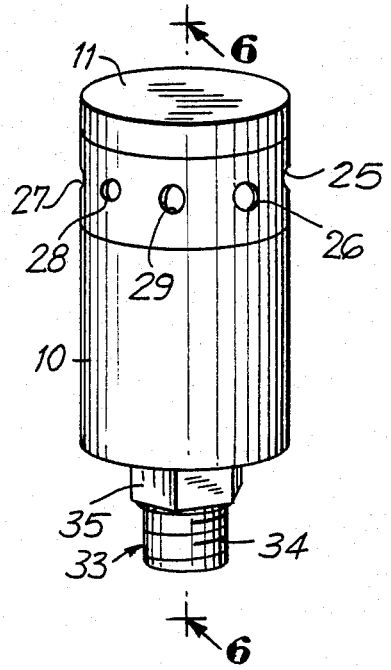

ADJUSTABLE AIR VALVE

BACKGROUND AND SUMMARY OF THE INVENTION

Adjustable air valves for conventional steam heating systems are known. Such valves are disclosed in U.S. Pat. No. 2,576,954.

The present invention relates to an improvement in adjustable valves of this type. More specifically, in accordance with the principles of the present invention, a new and improved air vent seal is provided.

In accordance with the present invention, the new air valve comprises a cylindrical valve body closed off in its upper and lower ends and attachable to a conventional radiator through a straight or angled threaded fitting. The valve has a rotatable, external collar having six apertures of varying sizes which may be rotated about a new and improved frusto-conical vent wall extending from the outer cylindrical envelope to a plane disposed inwardly of the cylindrical outer envelope. The vent opening at the inner portion of said frusto-conical vent wall is closed by a new and improved cylindrical sealing means having a flat circular sealing surface. This arrangement provides reliability of sealing, effective and reliable operation of the valve as well as facilitating manufacture of the valve of the present invention.

As with earlier and known adjustable air valves of this type, a bi-metallic element is disposed within the valve and carries a vent sealing elastomeric member. As will be understood, adjustment of the effective size of the venting orifice requires only a rotation of the collar to provide rapid venting in hard to heat areas of a steam heating system, or provides restrictive venting in overheated areas serviced by radiators in a conventional steam system.

The utilization of the valves of the present invention on each of the radiators in a conventional steam heating, multiple radiator system allows each radiator to heat extremely quickly with only ounces of vapor. Fuel consumption is conserved as the boiler is fired to build up the requisite pressure to service the entire system.

As will be appreciated, each radiator in the sytem can be adjusted to any one of many different orifices sizes, so that the entire steam heating system is balanced and equalized to provide fast and uniform heating in each area or room in which a radiator is located, thereby providing comfortable heating in each such area or room. Utilization of the new and improved air valves of the present invention eliminates the need to keep boilers firing as pressure increases in the steam heating system in order to reach remotely situated, and different to heat radiators. Moreover, the adjustable air valves of the present invention have sufficient venting capacity to be installed at the end of basement mains, when they are adjusted to the largest venting orifice within the collar to provide rapid air elimination from the system.

For a better understanding of the above and other features and advantages of the present invention, reference should be made to the following detailed description of preferred embodiments of the invention and to the accompanying drawings.

DESCRIPTION OF THE DRAWINGS

FIG. 1 is a perspective view of the new and improved adjustable air valve of the present invention with an angular fitting for connecting the same to a steam radiator;

FIG. 2 is an enlarged cross-sectional view of the valve of FIG. 1 taken along line 2—2 thereof;

FIG. 3 is a cross-sectional view of the valve of FIG. 2 taken along line 3—3 thereof;

FIG. 4 is a perspective view of the bi-metallic spring element of the present invention;

FIG. 5 is a perspective view showing the valve of the present invention with a straight threaded fitting; and FIG. 6 is a cross-sectional view taken along line 6—6 of FIG. 5.

DETAILED DESCRIPTION OF THE INVENTION

Referring now to the drawings and initially to FIG. 1, the valve of the present invention includes a cylindrical valve body 10 tightly closed off at its upper end by a circular disc cap 11 and tightly closed off at its lower end by a circular lower disc cap 12. Projecting through the lower portion and affixed to the lower portion of the valve body 10 is a threaded fitting 13 comprising a nipple 14 and a hexagonal integral collar 15. As will be understood, the nipple 14 permits communication between the radiator and the interior of the air valve to permit the venting of air from said radiator into said valve body and out of said valve body through an inner orifice 16 formed therein by the inner end of a frusto-conical vent wall 17 having a large outer diameter orifice 18 within the outer cylindrical envelope of the valve body 10. The inner orifice 16 is of smaller diameter than the orifice 18 and is disposed inwardly of the cylindrical envelope of body 10.

The vent orifice 16 may be selectively opened and closed to permit air to escape from the steam radiator by movement of a cylindrical elastomeric sealing member 19 having a circular flat face 20 of diameter in excess of the diameter of the opening 16 into and out of sealing contact with said opening 16 formed by the inner end of the frusto-conical wall portion 17.

More specifically, the sealing means 20 includes a smaller cylindrical mounting portion 21 which is inserted into an opening 22 formed in the distal end of a U-shaped bi-metallic spring element 23 which is cantilevered from an upper portion of the valve body opposite to said opening 16. As shown in FIG. 2, the bi-metallic spring 23 is securely fastened to the valve body through a rivet hole 24a by a rivet 24 connecting said bi-metallic spring 23 to said valve body.

The bi-metallic spring 23, as illustrated in FIG. 4, may be used in similar version of the valve illustrated in FIGS. 5 and 6 in which a threaded fitting 33 having a threaded nipple 34 and a collar 35 is disposed in a lower disc 32 having an orifice 33 therein to permit air to enter the valve body from the radiator through the lower end cap rather than from the lower portions of the valve body as in the embodiment of FIG. 1.

The remaining elements of the adjustable air valve of FIG. 6 are identical to that of the valve of FIG. 1 and bear the same reference numerals.

In accordance with the principles of the invention, a cylindrical collar 25 having a series (advantageously six) of graduated orifices 26–29 of sizes ranging from a largest opening generally corresponding to the size of the orifice 18 to a significantly smaller opening 27. The cylindrical collar 25 may be rotated about the outer portions of the valve body 10 in an annular recess 26 formed therein. Thus, the outer surfaces of the collar 25 are generally contiguous with the outer surface of the valve body 10, as shown in FIGS. 2 and 6.

In accordance with the principles of the invention, the rate of venting of air from a steam radiator can readily be adjusted by the juxtaposition of any one of the plurality of orifices 26, 27, 28, 29 with the outer orifice 18 formed by the outer portion of the frusto-conical vent wall 17. Thus, when adjusted to the largest venting orifice, for example, the adjustable air valve of the present invention has sufficient capacity to be installed at the end of basement mains for rapid air elimination. On the other hand, overheated areas can be regulated through the use of other sized orifices to supply the precise amount of air venting reired to restrict and to control the heating output. As will be appreciated, each radiator in an entire conventional steam system may be specifically and precisely adjusted by selecting any one of the various venting orifices 25–29 provided in the rotatable collar 25 of the adjustable valve of the present invention.

It will be understood and appreciated that radiators may be heated faster when they are vented faster by the adjustable air valves of the present invention. This will result in fuel economies by virtue of the reduction of the firing time otherwise required in a less precisely adjusted steam heating system utilizing valves having only a single rate of air vent. Moreover, the adjustable air valves of the present invention provide quick and efficient means for eliminating the undesirable hissing noises and leakage which are prevalent in many existing steam heat systems.

The above-described preferred embodiments of the adjustable air valve of the present invention are meant to be representative only, as certain changes may be made therein by persons skilled in the art without departing from the clear teachings of the present invention. Accordingly, reference should be made to the following appended claims in determining the full scope of the invention.

I claim:

1. An adjustable air valve for steam radiators, comprising (a) a cylindrical valve body of seamless brass having a predetermined outer diameter;

(b) an upper circular disc cap closing off the top end of said valve body;

(c) a lower circular disc cap closing off the lower end of said valve body;

(d) a frusto-conical vent wall portion defining an inner vent orifice of first fixed diameter formed integrally within said valve body proximate to said upper cap;

(e) said inner orifice lying in a flat vertical plane disposed radially inwardly of the outer cylindrical envelope of said valve body;

(f) a U-shaped bi-metallic spring cantilevered from inner portions of said valve body opposite said vent orifice;

(g) an elastomeric sealing member having a flat circular sealing surface of diameter in excess of the diameter of said inner vent orifice;

(h) said spring being adapted to expand and to contract in response to temperature variations to move said sealing surface selectively into and out of sealing contact with said inner orifice;

(i) a cylindrical collar band having a series of apertures of graduated size;

(j) said collar being mounted externally of said valve housing for circular movement thereabout and in juxtaposition with the outer portion of said frusto-conical vent which defines an outer orifice of second fixed diameter, whereby the effective diameter of the vent may be varied by selective juxtaposition of different sized apertures with said outer orifice; and (k) a threaded fitting disposed at the bottom of said valve body adapted to provide a communication with and attachment to a steam radiator.

2. The adjustable valve of claim 1, in which said threaded fitting extends horizontally from lower cylindrical portions of said valve body adjacent lower portions of said bi-metallic spring.

3. The adjustable valve of claim 1, in which said threaded fitting extends vertically from said lower disc cap.

* * * * *